US008106578B2

(12) United States Patent
Brown et al.

(10) Patent No.: US 8,106,578 B2
(45) Date of Patent: Jan. 31, 2012

(54) HIGHLY TRANSMISSIVE ELECTROLUMINESCENT LAMP HAVING A LIGHT EMISSIVE LAYER COMPOSITION INCORPORATING PHOSPHOR NANO-PARTICLES AND DIELECTRIC NANO-PARTICLES

(75) Inventors: Thomas L. Brown, Mesa, AZ (US); Manuel R. Adame, Chandler, AZ (US)

(73) Assignee: Oryon Technologies, LLC, Dallas, TX (US)

( * ) Notice: Subject to any disclaimer, the term of this patent is extended or adjusted under 35 U.S.C. 154(b) by 419 days.

(21) Appl. No.: 11/638,304

(22) Filed: Dec. 12, 2006

(65) Prior Publication Data

US 2008/0136314 A1 Jun. 12, 2008

(51) Int. Cl.
*H05B 33/00* (2006.01)
*H05B 33/14* (2006.01)

(52) U.S. Cl. ..... 313/502; 313/503; 313/501; 313/506; 428/917

(58) Field of Classification Search ..... 313/498–512; 428/690, 917
See application file for complete search history.

(56) References Cited

U.S. PATENT DOCUMENTS

| | | | | |
|---|---|---|---|---|
| 4,613,793 | A | 9/1986 | Panicker et al. | |
| 4,670,355 | A | 6/1987 | Matsudaira | |
| 4,733,488 | A | 3/1988 | Yokoyama et al. | |
| 5,496,427 | A | 3/1996 | Gustafson | |
| 5,786,664 | A | 7/1998 | Liu | |
| 5,976,613 | A | 11/1999 | Janusauskas | |
| 6,193,908 | B1 | 2/2001 | Hampden-Smith et al. | |
| 6,866,678 | B2 * | 3/2005 | Shenderova et al. | 607/88 |
| 6,870,313 | B2 | 3/2005 | Tramontana | |
| 2002/0121848 | A1 | 9/2002 | Lee et al. | |
| 2003/0006700 | A1 | 1/2003 | Yoneda | |
| 2004/0018343 | A1 | 1/2004 | Weder | |
| 2004/0018382 | A1 * | 1/2004 | Kinlen | 428/690 |
| 2004/0080256 | A1 | 4/2004 | Hampden-Smith et al. | |
| 2004/0161631 | A1 | 8/2004 | Liu et al. | |
| 2004/0173780 | A1 | 9/2004 | Kumar | |
| 2004/0183434 | A1 | 9/2004 | Yeh et al. | |
| 2004/0195548 | A1 | 10/2004 | Hampden-Smith et al. | |
| 2005/0024448 | A1 | 2/2005 | Cruz-Uribe | |
| 2005/0052121 | A1 | 3/2005 | Yamashita | |
| 2005/0052128 | A1 | 3/2005 | Nakanishi | |
| 2005/0052129 | A1 | 3/2005 | Yamashita | |
| 2005/0052131 | A1 | 3/2005 | Vecht et al. | |

(Continued)

OTHER PUBLICATIONS

International Searching Authority, International Application No. PCT/US07/24820, International Search Report and the Written Opinion, May 8, 2008.

(Continued)

*Primary Examiner* — Mariceli Santiago
(74) *Attorney, Agent, or Firm* — John A. Thomas

(57) ABSTRACT

We disclose a highly transmissive electroluminescent lamp, where the lamp has a front electrode electrically connected to a first clear conductive layer of PDOT or functionally similar material, a phosphor layer and a dielectric layer. The phosphor layer contains nano-particles of phosphor, where the nano-particles have a size less than about 100 nm. The dielectric layer contains nano-particles of a dielectric, where these nano-particles having a size less than about 100 nm. There is a second clear conductive layer of PDOT, and a back electrode electrically connected to the second clear conductive layer, for energizing the lamp. In other embodiments, the particles in the phosphor layer may have sizes larger than 100 nm, while still achieving the effect of substantial transparency of the lamp.

5 Claims, 3 Drawing Sheets

U.S. PATENT DOCUMENTS

| | | | |
|---|---|---|---|
| 2005/0064236 | A1 | 3/2005 | Lim et al. |
| 2005/0122027 | A1 | 6/2005 | Aiba et al. |
| 2005/0122034 | A1 | 6/2005 | Yamashita |
| 2005/0123675 | A1 | 6/2005 | Dorfman |
| 2005/0206302 | A1 | 9/2005 | Noguchi et al. |
| 2005/0287395 | A1 | 12/2005 | Yamashita |
| 2006/0049745 | A1 | 3/2006 | Handa et al. |
| 2006/0071263 | A1 | 4/2006 | Uchida |
| 2006/0132020 | A1 | 6/2006 | Kambe et al. |
| 2006/0134564 | A1 | 6/2006 | Chari |
| 2006/0138948 | A1 | 6/2006 | Ray |
| 2006/0158109 | A1 | 7/2006 | Takahashi |
| 2006/0192486 | A1 | 8/2006 | Ogawa |
| 2006/0197445 | A1 | 9/2006 | Watanabe |
| 2006/0220546 | A1 | 10/2006 | Chen et al. |
| 2006/0220547 | A1 | 10/2006 | Belinski-Wolfe et al. |
| 2006/0231795 | A1 | 10/2006 | Hampden-Smith et al. |
| 2006/0267788 | A1 | 11/2006 | Delaney |

OTHER PUBLICATIONS

International Bureau, International Preliminary Report on Patentability (Chapter 1 of the Patent Cooperation Treaty), Jun. 25, 2009.

* cited by examiner

HIGHLY TRANSMISSIVE ELECTROLUMINESCENT LAMP HAVING A LIGHT EMISSIVE LAYER COMPOSITION INCORPORATING PHOSPHOR NANO-PARTICLES AND DIELECTRIC NANO-PARTICLES

TECHNICAL FIELD

This disclosure relates to the field of electroluminescent lamps, in particular, to electroluminescent lamps highly transmissive to light.

BACKGROUND

A conventional electroluminescent (EL) lamp has a substantially transparent or transmissive substrate, a first transmissive electrode on the substrate, a back or second electrode opposite to the transmissive electrode, and an intermediate layer between the first and the second electrodes. The intermediate layer includes a dielectric layer and a means for producing light emission. The means for producing light emission is an electroluminescent phosphor.

With this structure, the electroluminescent lamp is luminous when an alternating electric voltage is supplied between the first and the second electrodes. Light emission occurs because electrons are excited to a conduction band by the electric field and are accelerated to activate luminescent centers in the phosphor from a ground state. Such activated luminescent centers emit light when they return to the ground state.

The dielectric layer included in the intermediate layer serves to increase the strength of the electric field developed in the electroluminescent layer. In addition, the dielectric layer is useful in raising the breakdown voltage of the electroluminescent lamp.

The means for increasing the strength of the electric field in the electroluminescent layer includes barium titanate, barium strontium titanate, yttrium oxide, aluminum oxide, silicon nitride, silicon oxynitride, tantalum pentoxide, lead titanate, and similar equivalents. These substances have varying characteristics of dielectric constant, moisture resistance, adhesion to other layers in the lamp, and optical refractive index.

A further desirable characteristic for an EL lamp is the transparency of the electrode in the desired light-emitting side of the lamp. Even more desirable for many applications would be a highly transmissive lamp, where the dielectric layer and phosphor layer were also highly transmissive, something so far not achieved because of the high refractive index of many such materials and the scattering of light in compositions. Double-sided lamps have been built that emit light from both sides, but which are not themselves transmissive to light. What is needed is a lamp that is highly transmissive all the way through, whether energized or de-energized.

DRAWINGS

DESCRIPTION

Figure 1:
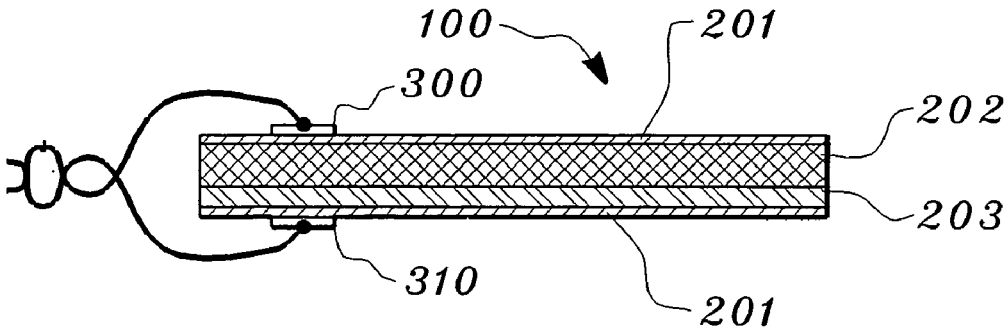
FIG. 1 is a cross section of an embodiment of the highly transmissive lamp having layers of clear conductive material, phosphor, dielectric material, and a clear conductive material.

EL lamps are typically constructed by screen-printing layers of inks in the desired patterns to form a complete, monolithic lamp. One such process for manufacturing such lamps is that shown by U.S. Pat. No. 5,856,030, the disclosure of which is incorporated into this application by reference. Other methods are well known in the art. The examples given in this specification, and the ratio limits for percent compositions below, are based on UV curable systems. Those skilled in the art, however, could make similar compositions suitable for thermally-cured systems.

The phosphor layers in typical EL lamps have phosphor particles with dimensions in the range of 10 to 30 microns. Similarly, the dielectric layers in current EL lamps have particles with dimensions in the range of 0.2 to 10 microns. These relatively large particles scatter light, both ambient light and the light produced by the EL emission, rendering current EL lamps practically opaque.

I have found that the phosphor and dielectric layers can be made highly transmissive by limiting the size of the particles therein to nano-particles having dimensions of less than about 100 nm, preferably less than 50 nm. Particles that have sizes approximately the wavelength of the light of interest are highly reflective, while particles that are less than half of the wavelength of light and preferably less than a quarter wavelength of light allow much more of the light to be transmitted through the film. At this size, visible light is diffracted around the nano-particle with very little reflection, absorption, or scattering. There may also be a significant increase in light production because more of the light generated inside a 50 nm phosphor particle, for example, propagates away from the particle than propagates away from a larger 20 to 30 micrometer particle. So, for a given weight of phosphor, there will be more smaller particles, and thus more light production per weight.

The small particles must be dispersed to minimize agglomeration and achieve the desired effect, but this is aided by the small size of the particles, which stay in suspension in the binder longer. Suitable dielectrics having particle sizes in the range of 50 nm or less may be obtained from TPL, Inc. of Albuquerque, N. Mex.

An example of an embodiment constructed with separate dielectric and phosphor layers is shown in the following table:

| Layer | Composition | Thickness | Coverage |
|---|---|---|---|
| envelope | polyurethane | 50-200 μm | entire lamp assembly |
| front electrode | silver and binder | 12-23 μm | around lamp perimeter |
| clear conductive | conductive polymer | 1-3 μm | light-emitting area |
| phosphor | binder and nano- | 25-80 μm | light-emitting |

-continued

| Layer | Composition | Thickness | Coverage |
|---|---|---|---|
| | particles | | area |
| dielectric | binder and nano particles | 8-16 μm | light-emitting area |
| clear conductive | conductive polymer | 1-3 μm | light-emitting area |
| back electrode | silver and binder | 12-23 μm | around lamp perimeter |
| envelope | polyurethane | 50-200 μm | entire lamp assembly |

In the foregoing table, the "binder" is preferably polyurethane, although vinyl, silicone, or other suitable binders could be used. The "clear conductive" layer is preferably a highly transmissive conductive organic polymer, such as PDOT (poly(3,4-ethylenedioxythiophene)), although indium-tin-oxide on film could be used, with some loss in flexibility, or indium-tin-oxide dispersed in an ink. Other possible conductive films include aluminum-added zinc oxide (generally called AZO) and indium-added zinc oxide (generally called IZO). The clear conductive material, when connected to electrodes, is the means for creating an electric potential across the phosphor and dielectric layers.

The phosphor layer is a mixture of phosphor particles in the size ranges described and a binder, preferably in a ratio of about 40 to 75% phosphor and 25 to 60% binder by weight. Phosphors may comprise compounds such as ZnS, ZnO, $TiO_2$ and $Y_2O_2$, preferably doped with elements such as manganese, copper, or silver. In one embodiment, the phosphor particles are also nano-particles. Methods of producing nano-sized phosphors are known in the art.

The dielectric layer is a mixture of nano-particles of a suitable dielectric such as barium titanate or barium strontium titanate or others mentioned above, and a binder as just described, preferably in a ratio of about 45 to 80% dielectric and 20 to 55% binder by weight.

In another embodiment, the phosphor and dielectric layer can be combined into a single layer. The combined phosphor-dielectric preferably has a composition of about 40% to 80% phosphor particles, 2% to 25% dielectric material and 10% to 58% binder, by weight.

The lamp described in the foregoing table was constructed and found to have a brightness of approximately 80 cd/$m^2$ from the front and about 50 cd/$m^2$ from the rear. A typical EL lamp emitting light only from the front was found to have a brightness of about 60 cd/$m^2$. Further, the lamp so constructed was highly transmissive, so that printed material could be read through it, even when the lamp was on.

In another embodiment, the highly transmissive EL lamp can be also constructed with phosphor particles as large as 30 μm, in either a mixture or separate layer, so long as the particles of the dielectric material are less than about 50 nm in size. We still achieve substantial transparency because there are relatively few such larger phosphor particles in the phosphor layer.

The figures show schematic cross sections of highly transmissive EL lamps in various embodiments.

FIG. 1 shows an embodiment of a highly transmissive EL lamp (100) having layers of clear conductive material (201), phosphor (202), dielectric (203), and clear conductive material (201). FIG. 1 shows placement of a front electrode (300) and back electrode (310) for providing electrical power to the clear conductive layers (201). Depiction of the electrodes (300, 310) is omitted in the remaining drawings.

Figure 2:
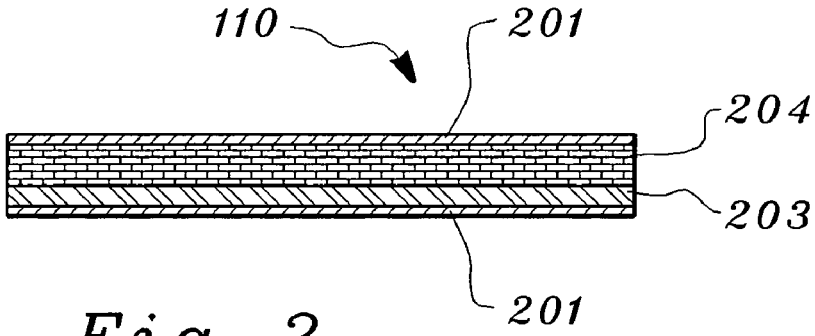
FIG. 2 is a cross section of an embodiment of the highly transmissive lamp having layers of clear conductive material, phosphor, dielectric material, and a clear conductive material.

FIG. 2 shows an embodiment of a highly transmissive EL lamp (110) having layers of clear conductive material (201), the phosphor and dielectric composition (204), dielectric (203), and clear conductive material (201).

Figure 3:
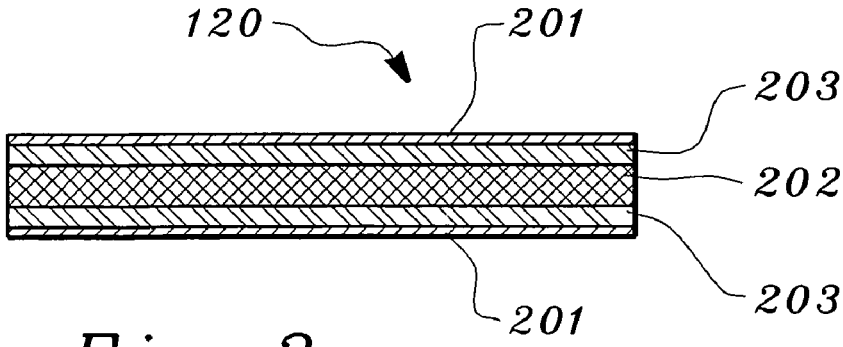
FIG. 3 is a cross section of an embodiment of the highly transmissive lamp having layers of clear conductive material, dielectric material, phosphor and dielectric material together, dielectric material, and a clear conductive material.

FIG. 3 shows an embodiment of a highly transmissive EL lamp (120) having layers of clear conductive material (201), dielectric (203), phosphor (202), dielectric (203), and clear conductive material (201).

Figure 4:
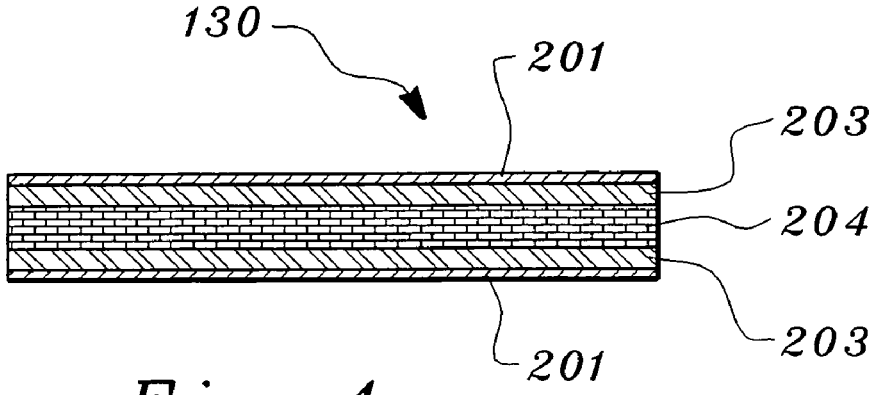
FIG. 4 is a cross section of an embodiment of the highly transmissive lamp having layers of clear conductive material, dielectric material, phosphor and dielectric material together, dielectric material, and a clear conductive material.

FIG. 4 shows an embodiment of a highly transmissive EL lamp (130) having layers of clear conductive material (201), dielectric (203), the phosphor and dielectric composition (204), dielectric (203), and clear conductive material (201).

Figure 5:
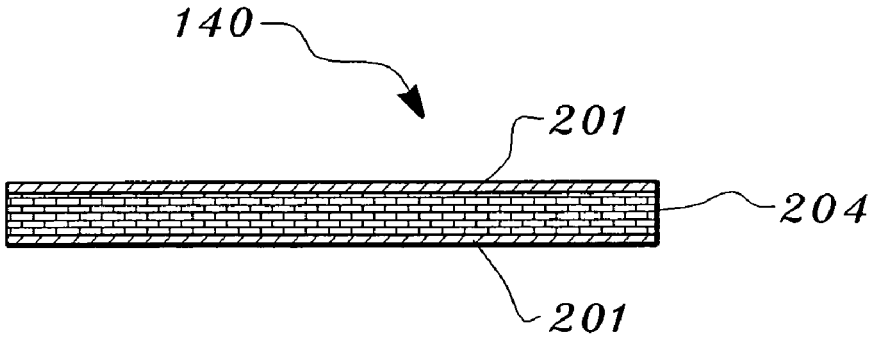
FIG. 5 is a cross section of an embodiment of the highly transmissive lamp having layers of clear conductive material, phosphor and dielectric material together, and a clear conductive material.

FIG. 5 shows an embodiment of a highly transmissive EL lamp (140) having layers of clear conductive material (201), the phosphor and dielectric composition (204), and clear conductive material (201).

Figure 6:
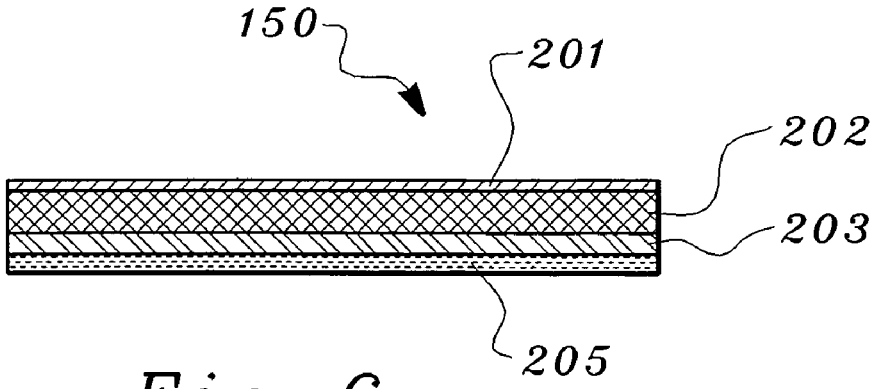
FIG. 6 is a cross section of an embodiment having a reflective background to enhance forward light transmission.

FIG. 6 shows an embodiment of a highly transmissive EL lamp (150) having layers of clear conductive material (201), phosphor (202), dielectric (203) and a reflective layer (205). Since the phosphor (202) and dielectric (203) are highly transmissive, light emitted toward the reflective layer (205) is reflected back through the lamp (150), enhancing its brightness in the forward direction. In one embodiment, silver may be used for the reflective layer (205).

The lamp shown in FIG. 6 may also be optimized to deliver maximum light from one side by making the phosphor layer (202) highly transmissive as described above, and optimizing the dielectric layer to be highly reflective instead of highly transmissive, thus acting as a reflective layer (205). The dielectric layer can be optimized for maximum reflectance at particle sizes around 0.25 microns to 4 microns. A distribution of sizes is acceptable.

Figure 7:
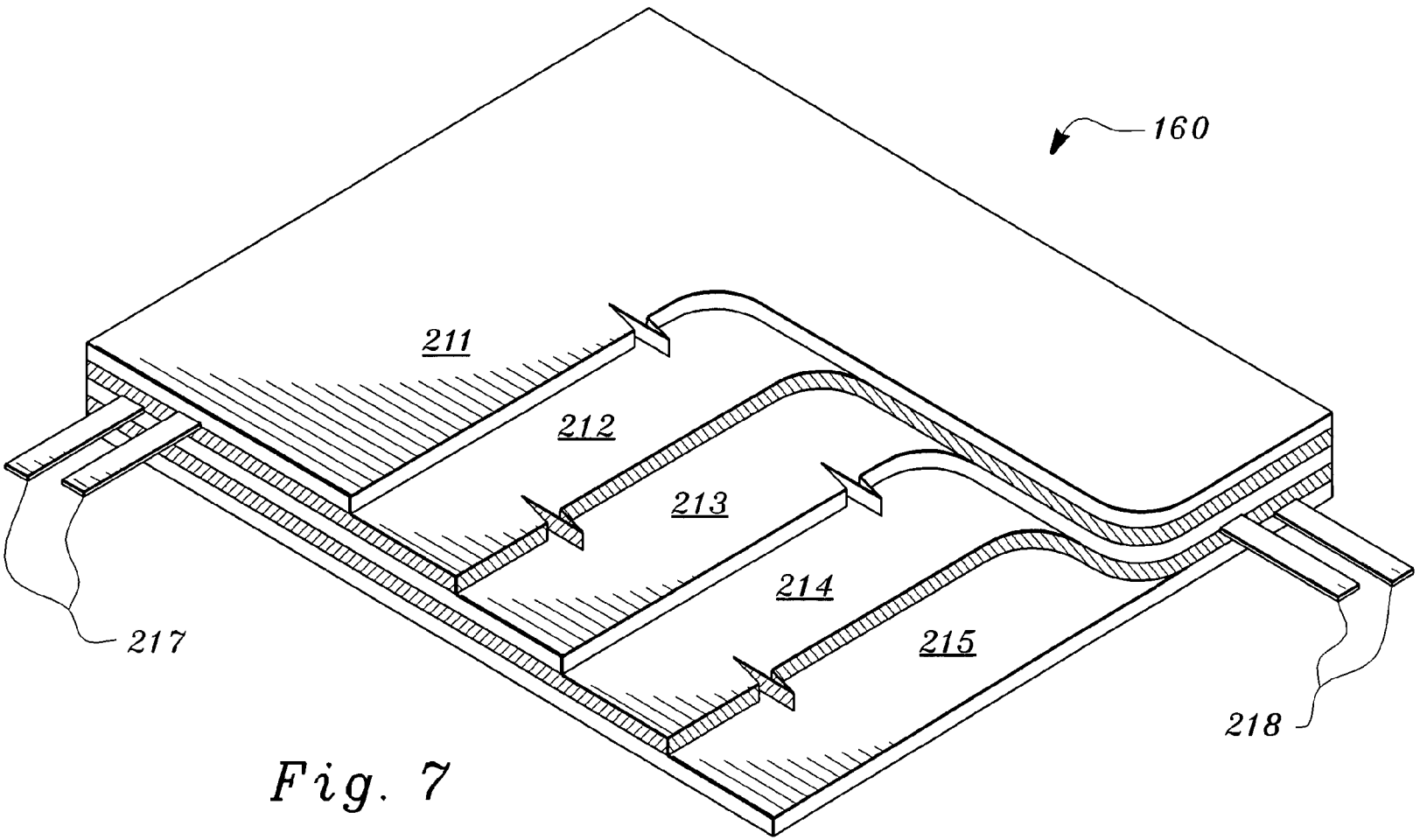
FIG. 7 shows stacked highly transmissive EL lamps.

FIG. 7 is an embodiment comprising two highly transmissive lamps of the types shown in FIGS. 2-5 in a stack (160). Two lamp layers (212, 214) are shown, but a plurality of such lamp layers could be stacked. In FIG. 7 the combination of lamps (160) has a first insulating layer (211), such as polyurethane, then a first lamp layer (212); a second insulating layer (213), and a second lamp layer (214); and a third insulating layer (215). Electrical connections (217, 218) are provided for the first and second lamp layers (212, 214) respectively. Such stacked highly transmissive lamps may each be of different phosphors to provide a different color output, the intensity of which is further adjustable by changing the voltage applied to each lamp layer (212, 214) in the stack (160) through the electrical connections (217, 218). The depiction in FIG. 7 is schematic and not to scale. Stacked lamps may be operated out of phase with each other to minimize noise generation.

Since those skilled in the art can modify the specific embodiments described above, I intend that the claims be interpreted to cover such modifications and equivalents.

We claim:

1. A highly light transmissive EL lamp having a light-emitting layer, where:

the light-emitting layer of the EL lamp comprises a composition of:

phosphor nano-particles;

dielectric nano-particles; and, a binder.

2. The EL lamp of claim 1, where the phosphor nano-particles comprise about 40 to 80% of the composition by weight;

the dielectric nano-particles comprise about 2 to 25% of the composition by weight; and, the binder comprises about 10 to 58% of the composition by weight.

3. The EL lamp of claim 1 where the phosphor nanoparticles have a size less than approximately 100 nm.

4. The EL lamp of claim 1 where the dielectric nanoparticles have a size less than approximately 100 nm.

5. A stacked EL lamp comprising:

a plurality of highly light transmissive EL lamp layers according to claim 1;

the highly light transmissive EL lamp layers separated by insulating layers;

each of the highly light transmissive EL lamp layers having an electrical connection for energizing the lamp layers.

* * * * *